US005092062A

United States Patent [19]

Palka

[11] Patent Number: 5,092,062

[45] Date of Patent: Mar. 3, 1992

[54] DISPLAY DEVICE

[76] Inventor: Mike F. Palka, 6405 S. Keeler Ave., Chicago, Ill. 60629

[21] Appl. No.: 265,945

[22] Filed: Nov. 2, 1988

[51] Int. Cl.[5] ..... G09F 1/10

[52] U.S. Cl. ..... 40/124.2; 40/124.4

[58] Field of Search ..... 40/124, 124.2, 124.4, 40/642, 359, 360, 649; 211/50, 55

[56] References Cited

U.S. PATENT DOCUMENTS

| | | | |
|---|---|---|---|
| 774,495 | 11/1904 | Richard | 40/124.2 |
| 786,176 | 3/1905 | Adams | 211/55 |
| 814,438 | 3/1906 | Franke | 211/55 |
| 831,539 | 9/1906 | Crowell | 40/124.2 |
| 932,830 | 8/1909 | Thomas | 40/124.2 |
| 2,041,756 | 5/1936 | Gray | 40/124.2 |
| 2,105,594 | 1/1938 | Henrich | 40/124.2 |
| 2,879,899 | 3/1959 | Shenkin | 211/55 |
| 3,458,944 | 8/1969 | Jiminez | 40/124.2 |
| 4,735,290 | 4/1988 | Byrley | 40/124.2 |
| 4,750,281 | 6/1988 | Magdovitz | 40/124.2 |

*Primary Examiner*—Gene Mancene
*Assistant Examiner*—Michael Lynch
*Attorney, Agent, or Firm*—Frederick J. Krubel

[57] ABSTRACT

A display device for holding and exhibiting placards and the like such as business cards, wherein a plurality of opentopped, card-receiving pockets are arranged on the front face of a main, plate-like body of a main, plate-like body of the display device; each card-receiving pocket is capable of receiving a plurality of placards in the form of a stack or batch and maintaining such placards in a neat upright stack with the outer face of the outermost placard of the stack clearly visible to a casual observer; the card-receiving pockets are integrally formed with the main plate-like which is made of transparent plastic material and permit a single placard to be easily grasped by the fingers of a person and removed therefrom.

10 Claims, 1 Drawing Sheet

DISPLAY DEVICE

BACKGROUND OF THE INVENTION

The present invention relates generally to card holders or racks and, more particularly, to a new and improved card display device for uniquely holding or supporting a plurality of packs or batches of placards, such as conventional business cards and the like, whereby removal of individual cards therefrom is unimpeded and facilitated, and for attractively exhibiting the cards whereby the entire face, and thus the inscription thereon, is substantially exposed for clear viewing by persons casually observing the card display device.

Essentially, business cards serve to identify persons and/or business enterprises, and the occupation, profession, or trade of such person or the particular business activity of the business enterprise. Consequently, business cards are capable of being used as an advertisement instrumentality since they effectively bring to the immediate attention of anyone reading a particular card of the availability for hire or employment of the identified individual or business enterprise to perform certain services for hire, such as legal, medical, and real estate sales, as set forth on the card. Obviously, the potential volume of business or employment and, thus, the monetary return that can be generated by a business card functioning simply as an advertisement instrumentality is directly related to the number of persons who are made aware of the card and actually read the same. The more persons viewing a particular business card, the greater will be the potential for increasing the business activities of the business card owner.

Accordingly, it is a primary objective of the present invention to provide a novel and attractive card display device for use in an area accessible to and observable by the public, such as restaurants, barber shops, waiting rooms or other places where people congregate, which is capable of supporting a multitude of different business cards in upright positions so as to allow the inscriptions thereon to be readily visible to casual observers of the card display device.

The following U.S. Pat. Nos. disclose display devices for holding and exhibiting cards, photographs or other similar items:

| | |
|---|---|
| 774,495 | Richard |
| 814,438 | Franke |
| 2,437,415 | Berry |
| 3,691,664 | Stoian |
| 4,041,631 | Stevens |
| 4,344,241 | Tourre |
| 4,432,460 | Bell |

While all of the display devices disclosed in the above-listed prior art patents relate generally to the subject matter of the present invention, some involve complex designs and are thus, costly to manufacture while others are incapable of holding a plurality of placards in individual pocket means in such a manner that a single placard may be easily removed from the pocket means without disturbing the other placards of the batch and the indicia on the outwardly facing placard of the batch of placards held in each pocket means is readily visible at all times. Moreover, many of the card display devices disclosed in the above-listed prior art patents are constructed of a multitude of parts which must be assembled and secured to each other to further increase manufacturing costs.

SUMMARY OF THE INVENTION

Accordingly, a primary objective of the present invention is the provision of a one-piece display device for holding and exhibiting placards, such as business cards and the like, wherein a multitude of pocket means are provided for removably supporting batches or stacks of the placards.

Another object of the invention is to provide a new and improved display device for removably holding and visually displaying a plurality of business cards and the like which is constructed of a single sheet of material.

Still another object of the invention is the provision of an inexpensively constructed business card display device for use in an area accessible to the public provided with a plurality of pocket means, each of which is capable of removably holding a plurality of business cards.

A further object of the invention is to provide a lightweight, yet durably constructed, display device having a plurality of pocket means for receiving and storing small placards wherein the placards are supported in a generally upright position and wherein the indicia appearing on the outwardly facing placard of the batch of placards held in each pocket means may be clearly seen and easily read by persons looking at the display device.

Briefly stated, the present invention contemplates the provision of a novel display device for holding and attractively exhibiting placards, such as business cards and the like. The display device embodying the invention is preferrably made from a single sheet of relatively thin transparent material and has a multitude of integrally formed pocket means arranged on the front face thereof. Each pocket means is capable of storing or holding a batch or stack of placards in such a manner that the indicia appearing on the outermost placard of each batch or stack of placards is readily visible and can be easily read by persons casually observing the display device. Each of the display pocket means includes a horizontally extending, placard support flange which projects generally forwardly from the front face of display device and is adapted to serve as a ledge for supporting a batch or stack of placards. Each pocket means also comprises a pair of horizontally spaced and parallel side lips and a single horizontally extending bottom lip which side and bottom lips are adapted to embrace the side marginal edges and the lowermost marginal edge, respectively, of the outermost placard of the batch or stack received within the pocket means. A display device pocket means constructed in accordance with the present invention readily permits the replenishment of placards when needed and such pocket means construction will not impede or hamper in any way the easy removal therefrom of a single placard when desired.

It is to be understood that the term "placard" as used here-before and as will be used hereafter in the description of the invention and its uses may also include photographs, postcards, paint chips, or other similar items, as well as business cards.

The foregoing and other important objects and desirable features inherent in and encompassed by the invention, together with many of the purposes and uses thereof, will become readily apparent from a reading of the ensuing description in conjunction with the annexed drawings, in which:

DETAILED DESCRIPTION OF THE PREFERRED EMBODIMENT OF THE INVENTION

Figure 1:
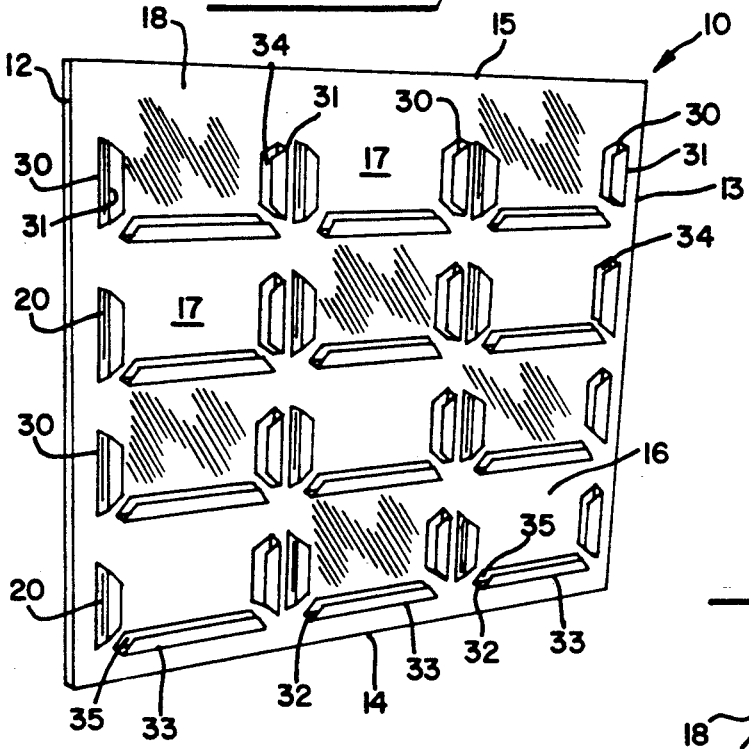
FIG. 1 is a perspective view of a placard display device embodying the invention; the display device is shown devoid of placards.
Figure 2:
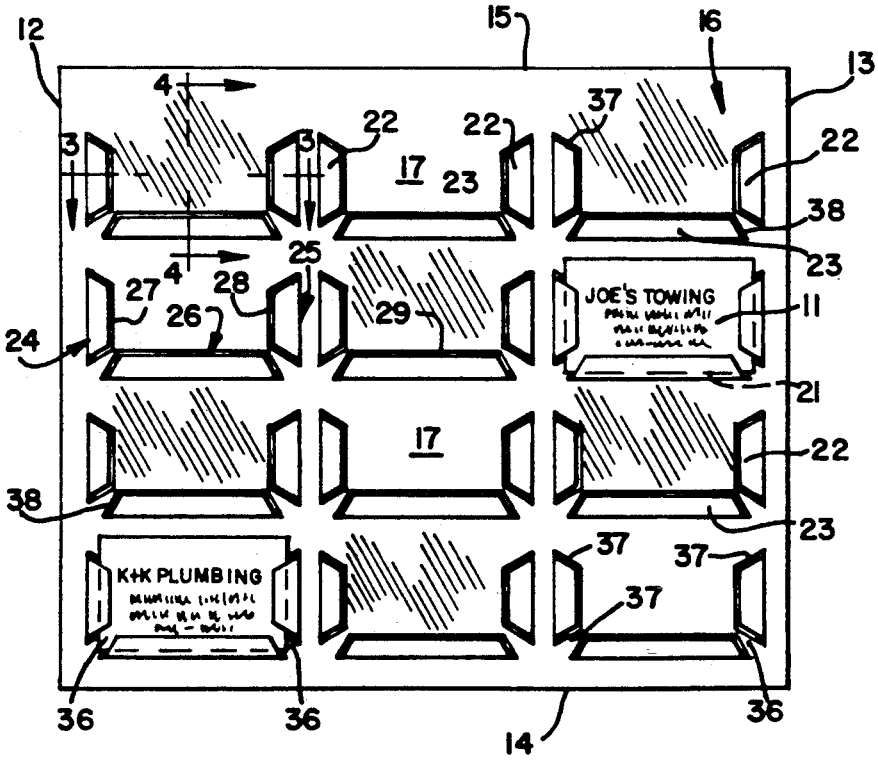
FIG. 2 is a front elevationsl view of the display device illustrated in FIG. 1 with the exception that each of two of the placard holders or pocket means provide on the front face of the display device contains a batch or stack of business cards.

Referring to the drawings in detail, wherein like reference characters represent like elements throughout the various views, reference character 10 is used to designate the placard display device in its entirety. The display device 10 is generally rectangular in shape and when being used to exhibit placards 11 and the like is suitably supported in an upright position and is oriented or adjusted so that the spaced and parallel, short marginal edges 12, 13 of the rectangular display device 10 extend substantially vertically while the spaced and parallel relatively longer, top and bottom marginal edges 14, 15, respectively, extend substantially horizontally as shown in FIGS. 1 and 2. The display device 10 is made from a single, relatively thin and flexible, plate or sheet 16 of transparent plastic material. The plate 16 has a generally rectangular configuration and possesses sufficient stiffness so as to be capable of standing in a generally upright position without collapsing or unduly bending merely by leaning against a suitable back support.

As best illustrated in FIGS. 1 and 2, the display device 10 is provided with a plurality of open-topped placard holders or pocket means, designated generally by reference character 17, on its forwardly facing side 18. The open-topped pocket means 17 are preferably arranged in vertically spaced, horizontal rows. The display device 10 illustrated in the drawings is provided with twelve placard pocket means 17 arranged in four vertically spaced rows of three pocket means 17 each. It is to be understood that the display device 10 could be constructed with a greater or lesser number of pocket means 17 which are arranged in a greater or lesser number of vertically spaced rows 17 consisting of one or more pocket means each without departing from the spirit and scope of the invention.

Figure 3:
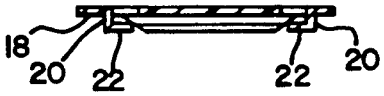
FIG. 3 is a horizontal sectionsl view taken substantially along line 3—3 of FIG. 2 illustrating structural detajls of one of the placard holder or pocket means.
Figure 4:
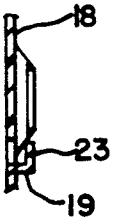
FIG. 4 is a vertical sectional view taken substantially along line 4—4 of FIG. 2 showing further structural details of a placard holder or pocket means.

Inasmuch as all of the open-topped placard holders or pocket means 17 possess exactly the same structural details and are formed or constructed in the same manner, only the placard pocket means 17 appearing in the uppermost, left hand corner of the display device 10 illustrated in FIG. 2 will be described in detail. In essence, each placard holder or pocket means 17 includes a single horizontally extending placard support ledge 19 which projects forwardly substantially at right angle from the general plane containing the front face surface 18 of the plate or sheet 16 and defines the bottom of the open-topped pocket means 17, as illustrated in FIG. 4. It will be appreciated that ledge 19 is substantially flat and has a length considerably greater than its width whereby a substantial mid portion of the lowermost edge of each of the placards 11 of the stack of placards 11 received in the pocket means 17 is firmly supported thereby. Only the relatively short bottom edge portions at the bottom corners of the placards 11 defining the extreme ends of the lowermost edge of each placard are not actually engaged by the ledge 19. As best shown in FIG. 3, the transversely spaced sides of each open-topped placard pocket means 17 are defined by a pair of vertically extending flanges 20. The flanges 20 project substantially at right angles from the front face surface 18 of the rectangular plate or sheet 16 and lie in vertical planes which are horizontally spaced and substantially parallel with respect to each other. Preferably, the side flanges 20 are horizontally spaced a distance slightly greater than the width of a conventional business card which is approximately 3½ inches. From the foregoing it will be appreciated that when a batch or stack of business cards 11 is placed in the open-topped pocket means 17 with the lowermost edges 21 of the business cards 11 resting upon the elongated horizontally extending support ledge 19, the business cards 11 are constrained from moving sideways by the vertically extending side flanges 20. and vertically downwardly by the support ledge 19.

In order to prevent the placards 11 from accidentally falling out of the placard pocket means 17 and yet permitting a single placard 11 to be easily grasped by the fingers of a person and removed therefrom, each pocket means 17 includes a pair of vertically extending side retainer lips 22 which project toward each other and a horizontally extending, upwardly projecting bottom retainer lip 23. The side and bottom retainer lips 22, 23, respectively, lie substantially in plane spaced forwardly of and substantially parallel to the generally flat, forwardly facing surface 18 of the plate or sheet 16. From the foregoing, it will be appreciated that the side and bottom retainer lips 22, 23, respectively, slightly overlap and loosely engage or embrace a substantial portion of each of the side and bottom marginal edges of the outermost placard 11 of the batch or stack of placards 11 received in the placard pocket means 17 to thus store or retain the placards 11 contained in the pocket means 17 in neat, upright stacks or batches with only the face of the outermost placard 11 of each stack clearly in view. Moreover, the ample spacing provided between the side and bottom retainer lips 22, 23, respectively, of each placard pocket means 17 allows the pocket means 17 to be filled or loaded with a batch or stack of placards 11 of a relatively large number. Thus, the frequency of replenishing the pocket means 17 with placards 11 is substantially reduced.

There are many manufacturing processes which can be employed to produce the placard display device embodying the invention. However, a preferred manufacturing process involves the construction of each placard pocket means 17 in the following manner. A single flat, generally rectangular and relatively thin sheet or plate 16 of transparent or clear plastic material is first provided. The material of the sheet or plate 16, as an example, is polycarbinate, which is available commerically under the name of Lexan. However, it is to be understood that the sheet or plate 16 may be made from other plastic materials having the same or substantially the same physical and functional properties as Lexan without departing from the spirit and scope of the invention. Each of the pocket means 17 is produced by slitting or cutting the plate or sheet 16 at a particular area thereof to provide three interrelated tabs 24, 25, 26. Each of the tabs 24, 25, 26, has a configuration generally resembling an isosceles trapezoid polygon. The edge 27 of the tab 24 defining the free end thereof is spaced and substantially parallel to the comparable edge 28 of the tab 25, whereas, the edge 29 of the tab 26 defining the free end thereof extends between and is substantially perpendicular to the free end edges 27, 28 of tabs 24, 25, respectively.

In order to form the vertically extending side flanges 20 and the side lips 22 of the placard pocket means 17, each of the tabs 24, 25 is bent 90° along a vertically extending fold line 30, as viewed in FIG. 2, so as to project generally forwardly from the front face or surface 18 of the plate or sheet 16. Thereafter, an elongated portion of each tab 24, 25 of the free end thereof is further bent 90° along a vertical fold line 31 so as to lie substantially in a plane spaced and substantially parallel with respect to the plane of the front face or surface of the plate or sheet 16. From the foregoing, it will be appreciated that the elongated portions of the tabs 24 and 25 resulting from the deformation of tabs 24, 25 in the aforesaid manner correspond to the side retainer lips 22 of the open-topped pocket means 17. The remaining elongated portion of each side tab 24, 25 lies substantially in a plane perpendicular to the plane of the plate front face 18, as pointed out hereinbefore, and corresponds to a respective vertical side flange 20 of the pocket means 17.

The bottom support ledge 19 and bottom retainer lip 23 of each pocket means 17 are formed by first bending the tab 26 forwardly from the front face 18 of the plate 16 approximately 90° along a horizontally extending fold line 32. Thereafter, the elongated free end portion of the tab 26 is further bent 90° along fold line 33 to form the bottom retainer lip 23 of the open-topped pocket means 17.

As clearly illustrated in FIG. 1, the largest vertical dimension of the trapezoidally-shaped slot or hole 34 which corresponds to the length of the fold line 30.

As clearly illustrated in FIG. 1, the vertical length of the fold line 30, which corresponds to the largest vertical dimension of the trapezoidally-shaped slot or hole 34 formed in the plate 16, at each side of each pocket means 17, is less than the vertical height of the standard-sized placard 11 which is to be accommodated in the pocket means 17. In a similar manner, the largest horizontal dimension of the trapezoidally-shaped slot or hole 35 formed in the plate 16 at the bottom of each pocket means 17 corresponds to the fold line 32 and such fold line 32 has a length which is considerably less than the horizontal length of the placard 11 which is to be placed in the pocket means 17. Thus the rearwardmost placard 11 of the stack of placards 11 placed in each pocket means 17 has each of its lowermost corners overlying a solid portion 36 of the plate 16 provided at the lowermost end of each slot or hole 34 and a respective horizontal end of the bottom slot or hole 35. Moreover, the uppermost corners of the placard 11 overlie the plate 16 also. Thus, the placards 11 are incapable of accidentally passing or slipping through the slots 34 and 35 when the display device 10 is being used.

It will also be appreciated that since the side tabs 24 and 25 of each of the pocket means have a generally isosceles trapezoidal configuration, as described above, the top and bottom edges 37 of the side retainer lips 22 and the side flanges 20 are tapered or inclined, as shown in FIGS. 1 and 2. In a similar fashion, the edges 38 defining the horizontally spaced ends of the bottom support ledge 19 and the bottom retainer lip 23 are also tapered. It will be appreciated that by tapering the top edges 37 of the side retainer lips 22 and the side flanges 20 so that they extent generally downwardly and inwardly as well as tapering the side edges 38 of the bottom retainer lip 23 and bottom support ledge 19 so that they extend generally upwardly and inwardly as viewed in FIG. 2, placement of a plurality of placards 11 within the pocket means 17 is facilitated. Moreover, by tapering the top edges 37 of the side retainer lips 22 and the side flanges 20 of each pocket means 17, a single placard 11 may be readily grasped by the fingers of a person and easily removed from the pocket means 17.

In operation, the display device 10 is attached to a generally vertical wall surface by any suitable means so as to be supported in a generally vertical position as shown in FIG. 1. The display device 10 may also be simply propped against a vertical surface and not attached thereto with the bottom edge 14 thereof resting upon a horizontal supporting surface since, as pointed out hereinbefore, the material of the sheet 16 and its thickness impart sufficient stiffness thereto so as to be self-supporting. However, if desired a plate-like backing, not shown, of heavy cardboard or other suitable material could be secured or fastened to the backside of the sheet or plate 16 to further strengthen and enhance the stiffness of the card display device 10.

Each of the card display pocket means 17 is filled with a stack or batch of placards 11. It will be appreciated that each pocket means 17 retains the placards 11 received therein in neat stacks with only the outermost placard 11 of each stack prominently displayed. The card display device 10 embodying the present invention is particularly adaptable for use in barber shops or beauty salons, restaurants, bank lobbies, drug stores, dentist's and doctor's offices, waiting rooms or other places where people congregate or frequent.

From the foregoing, it will be appreciated that the card display device 10 of the present invention possesses several structural features which are unique in the art and yet is inexpensively constructed. Each of the plurality of open-topped pocket means 17 provided by the card display device 10 permits the neat and efficient storage of a stack or batch of placards 11 comprising a relatively large number of placards 11, as distinguished from a single placard 11, whereby the outermost placard 11 of the stack is supported in a generally upright position with the entire front face thereof substantially unobstructed and clearly visible. Consequently, the indicia appearing on the front face of the outermost placard 11 of the stack is easily readable by a casual observer.

The embodiment of the invention chosen for the purposes of description and illustration herein, is that preferred for achieving the objects of the invention and developing the utility thereof in the most desirable manner, due regard being had to existing factors of economy, simplicity of design and construction, manufacturing techniques, and the improvements sought to be effected. It will be appreciated, therefore, that the particular structural and functional aspects emphasized herein are not intended to exclude, but rather to suggest, such other adaptations and modifications of the invention, as fall within the spirit and scope of the invention as defined in the appended claims.

What is claimed is:

1. A display device for holding and exhibiting placards and the like, comprising, a generally planar, relatively thin plate made of transparent material having substantially straight and parallel edges; and a plurality of individual, open-topped pocket means arranged on a respective face of said plate, each of said pocket means being capable of removably receiving a plurality of placards in the form of a stack therein and exhibiting substantially the entire front face of only a respective one of the placards received therein and including a pair of side retainer means effective to constrain sideways movement of the placards received therein and bottom support means for engaging a substantial mid-portion of each of the bottom edges of the placards received therein to support the same, each of said bottom support means lying generally in a plane perpendicular to the plane containing said respective face of said plate, and said side retainer means and bottom support means of each of said pocket means being integrally formed with said plate.

2. A display device for holding and exhibiting placards and the like as set forth in claim 1, wherein each of said pocket means further includes, a pair of side lip means lying in a plane spaced and substantially parallel with respect to said respective face of said plate, each of said side lip means being associated with and integrally formed with a respective one of said side retainer means.

3. A display device for holding and exhibiting placards and the like as set forth in claim 2, wherein each of said pocket means further includes bottom lip means lying substantially in said plane containing said side lip means, said bottom lip means said bottom lip means being integrally formed with said bottom support means.

4. A display device for holding and exhibiting placards and the like as set forth in claim 1, wherein said plate is made of transparent material; and said retainer means and bottom support means of each pocket means are integrally formed with said plate.

5. A display device for holding and exhibiting placards and the like, comprising, a generally planar, relatively thin plate made of transparent material having substantially straight and parallel side edges; and a plurality of individual, open-topped pocket means arranged on a respective face of said plate, each of said pocket means being capable of removably receiving a plurality of placards in the form of a stack therein and exhibiting substantially the entire front face of a respective one of the placards received therein and including, a pair of elongated side retainer flanges spaced and substantially parallel with respect to each other and said side edges of said plate, each of said side retainer flanges projecting substantially normal from said respective face of said plate and being integrally formed with said plate, said side retainer flanges being effective to constrain sideways movement of the placards received therein, and each of said pocket means further including an elongated bottom support ledge for engaging the bottom edges of the placards received therein to support the same, said bottom support ledge extending in a direction substantially perpendicular to and being disposed between said side retainer flanges, said bottom support ledge projecting substantially normal from said respective face of said plate and being integrally formed with said plate.

6. A display device for holding and exhibiting placards and the like as set forth in claim 5, wherein each of said pocket means further includes a pair of elongated side lips generally lying in a plane spaced and substantially parallel with respect to said respective face of said plate, each of said elongated side lips being associated with a respective one of said side retainer flanges and having a longitudinal edge thereof integrally formed with a longitudinal edge of the side retainer flange associated therewith and each of said elongated side lips projecting toward the other elongated side lip from the respective side retainer flange associated therewith.

7. A display device for holding and exhibiting placards and the like as set forth in claim 6, wherein each of said pocket means further includes an elongated bottom lip lying substantially in said plane containing said elongated side lips, said elongated bottom lip having a longitudinal edge thereof, integrally formed with a longitudinal edge of said bottom support ledge, and said elongated bottom lip projecting toward said elongated side lips from said bottom support ledge.

8. A display device for holding and exhibiting placards and the like, comprising, a generally planar, relatively thin and rectangularly-shaped plate made of transparent material having spaced and substantially parallel side edges and spaced and substantially parallel top and bottom edges; and a plurality of individual open-topped pocket means arranged in a plurality of columns spaced and parallel with respect to the side edges of said plate, each of said columns comprising a plurality of open-topped pocket means spaced with respect to each other and the top and bottom edges of said plate, each of said pocket means being capable of removably receiving a plurality of placards in the form of a stack therein and exhibiting substantially the entire front face of a respective one of the placards received therein and including, a pair of elongated side retainer flanges spaced and substantially parallel with respect to each other and the side edges of said plate, each of said side retainer flanges being integrally formed with said plate and projecting substantially normal from said respective face of said plate, said side retainer flanges being effective to constrain sideways movement of the placards received therein, a pair of elongated side lips generally lying in a plane spaced and substantially parallel with respect to said respective face of said plate, each of said elongated side lips being integrally formed with a respective one of said side retainer flanges along a longitudinal fold line spaced and substantially parallel with respect to the side edges of said plate, each of said elongated side lips projecting toward the other elongated side lip from the respective side flange with which it is integrally formed, each of said open-topped pocket means further including, an elongated bottom support ledge for engaging the bottom edges of the placards received therein to support the same, said bottom support ledge being integrally formed with said plate and projecting substantially normal from said respective face of said plate, said bottom support ledge being disposed between said retaining flanges and extending in a direction substantially perpendicular thereto, and an elongated bottom lip integrally formed with said support ledge along a longitudinal fold line extending substantially perpendicular to the side edges of said plate.

9. A display device for holding and exhibiting placards and the like as set forth in claim 8, wherein each of said side and bottom lips has a generally isosceles trapezoidal configuration.

10. A display device for holding and exhibiting placards and the like as set forth in claim 9, wherein each of said side retainer flanges and said bottom support ledges has a generally isosceles trapezoidal configuration.

* * * * *